United States Patent [19]

Ambasz

[11] 4,333,683

[45] Jun. 8, 1982

[54] CHAIR WITH AUTOMATICALLY ADJUSTABLE TILTING BACK

[75] Inventor: Emilio Ambasz, New York, N.Y.

[73] Assignee: Center for Design Research and Development N.V., Curacao, Netherlands Antilles

[21] Appl. No.: 56,790

[22] Filed: Jul. 11, 1979

Related U.S. Application Data

[63] Continuation-in-part of Ser. No. 966,123, Dec. 4, 1978, abandoned.

[51] Int. Cl.[3] ..... A47C 5/12; A47C 7/40

[52] U.S. Cl. ..... 297/292; 297/DIG. 1; 297/DIG. 2; 297/300; 297/337

[58] Field of Search ..... 297/DIG. 1, DIG. 2, 297/296, 300, 302, 449, 454, 219, 284, 285, 291, 292, 293, 322, 337, 342, 343, 354

[56] References Cited

U.S. PATENT DOCUMENTS

| | | | |
|---|---|---|---|
| 1,444,521 | 2/1923 | Pearl | 297/219 |
| 2,131,609 | 9/1938 | Alexander | 297/296 X |
| 2,446,185 | 8/1948 | Aasucci et al. | 297/337 |
| 3,027,195 | 3/1962 | Nelson et al. | 297/DIG. 2 |
| 3,982,785 | 9/1976 | Ambasz | 297/160 |
| 4,032,190 | 6/1977 | Muller-Deisig | 297/300 X |
| 4,068,889 | 1/1978 | Pierce | 16/DIG. 13 |
| 4,084,850 | 4/1978 | Ambasz | 297/317 |
| 4,115,902 | 9/1978 | Taylor | 16/DIG. 13 |
| 4,193,164 | 3/1980 | Okayama | 16/DIG. 13 |

FOREIGN PATENT DOCUMENTS

| | | | |
|---|---|---|---|
| 2619538 | 8/1948 | Fed. Rep. of Germany | 297/296 |
| 2048326 | 4/1972 | Fed. Rep. of Germany | 297/DIG. 2 |
| 1164627 | 9/1969 | United Kingdom | 16/DIG. 13 |

*Primary Examiner*—James T. McCall

[57] ABSTRACT

A chair comprises a unitary seat and lower back and a separate upper back mounted on the lower back to tilt backward from a yieldably restrained, relatively upright position by at least one resilient articulating linkage. The chair may also have a second seat component nested in and slidable forward and backward on the seat portion of the unitary seat and lower back.

18 Claims, 37 Drawing Figures

CHAIR WITH AUTOMATICALLY ADJUSTABLE TILTING BACK

This application is a continuation-in-part of copending U.S. application Ser. No. 966,123 filed Dec. 4, 1978, and abandoned upon the filing hereof.

FIELD OF THE INVENTION

This invention relates to a chair of generally the "shell" type having a back which tilts from a yieldably restrained, upright position and, optionally, a seat which slides backward and forward.

BACKGROUND OF THE INVENTION

Nearly all people who are employed in "white collar" (office) jobs spend more than half their waking hours seated. Ergonomists and doctors have found that poor sitting postures contribute significantly to back problems and that a worker who spends long hours leaning forward over a desk is subject to considerable strain on the muscles and other tissues of the back. Alleviating that strain requires frequent relaxation of the back muscles, which is best accomplished by leaning back from time to time to a relaxed or reclined posture. In a relaxed position, muscular exertion is reduced to a minimum. Actual observations by ergonomists have shown, in fact, that a seated person ordinarily changes position every eight to 10 minutes.

The fixed geometry of most institutional and office seating is poorly adapted to provide good support for the anatomical back of a seated person in other than a single position (if at all). Usually, such seating is designed to provide support for the anatomical back when the person sits upright. When the person leans back to a relaxed position, he normally slides forward on the seat and presses back against the seat back, but his middle back (in the area of the lower thoracic vertebrae and lumbar vertebrae) is largely unsupported in the relaxed posture, thus putting a different sort of strain on the back from the strain of sitting upright, but a strain nonetheless. A meaningful reduction of that strain requires that the anatomical middle back be supported in the relaxed position; only with such support can the strain of sitting upright be effectively relieved by leaning back from time to time.

The inventor of the present invention has previously made significant improvements in the comfort of institutional, contract and office chairs by mounting the seat on seat supports for backward and forward movement and mounting the back on back supports so that the back tilts backward from a resiliently restrained, relatively upright position. Chairs embodying those improvements, which are described and shown in U.S. Pat. Nos. 3,982,785 and 4,084,850, automatically change in geometry to conform to any of a range of sitting postures between sitting erect and reclining or stretching quite far backward and thus provide comfortable support throughout a wide range of sitting postures. Some of the chairs specifically described and shown in U.S. Pat. No. 4,084,850 are being marketed under the trademark "Vertebra" and have been widely acclaimed. The telescoping principle of mounting the seat disclosed in that patent has proven to be an effective, relatively low cost way of mounting the seat on a simple tubular frame member.

A very popular type of institutional chair which has been commercialized in a variety of forms uses a one-piece seat and back of molded fiberglass, plywood, metal or high-impact strength plastic mounted on legs, a pedestal or a beam (ganged seating). This type of seating is inexpensive, reasonably durable (in good quality forms), and fairly comfortable in the seating posture for which it was designed. It is, however, distinctly uncomfortable in other seating postures; the hard surface and fixed geometry do not permit one sitting in a chair of this type to be comfortably supported in, for example, a backwardly reclined position. Because people cannot sit in one position for long periods of time without tiring and relief of back strain requires good support of the back in the relaxed, leaning back posture, as discussed above, almost all institutional seating, the seating commonly used in auditoriums, conference rooms, and lecture rooms in schools, to name a few examples, produces fatigue and diminished alertness and attentiveness, the longer people sit in such seating.

SUMMARY OF THE INVENTION

There is provided, in accordance with the present invention, an institutional chair which is relatively inexpensive to make, highly durable, versatile in respect of the form of legs, pedestal or beam, which can be used with the basic seat and back unit and, most importantly, very comfortable in a range of sitting positions between relatively upright and a slumped, backwardly reclined, relaxed position. A chair, according to the invention, comprises a unitary seat and lower back, a separate upper back and at least one resilient articulating linkage mounting the upper back on the lower back for backward tilting from a yieldably restrained, relatively upright position. The chair may also have a second seat component nested in and slidable forward and backward on the seat part of the unitary seat and lower back. The horizontal axis about which the upper back tilts is at a height above the seat corresponding to about the middle of the anatomical back of an adult human sitting in the chair. Preferably, the lower edge of the upper back is downwardly convexly curved transversely, and the upper edge of the lower back is curved to match and is closely spaced from the lower edge of the upper back. This configuration makes the height of the upper back at and near the center generally coextensive with the major part of the anatomical middle back of an adult human (say from approximately the waist to the shoulder blades). The location of the axis of articulation of the upper back somewhat above the lower edge of the center part of the upper back provides for forward movement of the lower part of the upper back when the upper back tilts backward, thus better supporting the back of a person slumping or reclining, and helps to balance the forces on the chair back above and below the axis of articulation. The seat and lower back and the upper back are, preferably, contoured longitudinally and transversely to conform generally to the anatomical shapes of the parts of an adult human which are supported by the chair. (All references herein to adults are intended to be read broadly because there is, obviously, no reason why these chairs cannot be made for young people and children, scaled down in size to fit them.)

The unitary seat and lower back and the upper back may be manufactured from steel or some other metal or from wood, such as molded plywood, but they are perhaps best made of a rigid, high-impact strength polymeric material, such as polypropylene, an ABS plastic (copolymer of acrylonitrile butadiene and styrene), or a fiberglass-resin. Generally, it is preferable for cost reasons not to have any supporting framework, but if necessary, stiffening or strengthening elements can be incorporated into the seat and back structure. The specific structural configuration of the seat and back parts is within the skill of the art, particularly as derived from one-piece institutional chairs of the type described above.

The resilient articulating linkage used to mount the upper back on the lower back can take various forms, such as those described and shown in U.S. Pat. Nos. 4,084,850 and 4,157,203. Preferably, the resilient articulating linkage comprises an upper link and a lower link joined by a pin, rivets or the like for articulation and received in complementary sockets in the lower back and upper back, some form of spring system resiliently urging the links into a relatively upright position, and stops establishing the upright position and the full-backward tilted position of the upper back. Some preferred embodiments of articulating linkages are shown in the accompanying drawings and described below. Although it is entirely feasible to have a single linkage located at the center of the chair back, it is preferable to use two linkages spaced apart laterally. A linkage at each side of the back will usually be best for ergonomical, mechanical and aesthetic reasons. The edges of the socket openings will ordinarily be vertically spaced apart, in which case a flexible, extensible tubing connected between the sockets can be used to conceal and protect the otherwise exposed parts of the linkages.

With the configuration of a chair, according to the invention, as described thus far, the upper back is normally restrained in a relatively upright or erect position and provides comfortable support for the middle back of a person sitting upright in the chair. In the erect or upright posture, the seat (of course) supports one's thighs and posterior, and the lower back of the unitary seat and lower back supports one's lower back. When one arches backward without slumping down to a somewhat reclined, relaxed position, the upper back (of the chair) automatically shifts to a backward tilted position to provide comfortable support for one's middle back. When one slumps, he or she will naturally and unconsciously slide forward on the seat, and his or her back will push the upper back of the chair to a backward tilted position. Unlike conventional institutional chairs with fixed backs, which provide support along only a narrow band at the top edge of the chair back for the anatomical back of a person who assumes even a slightly slumped or reclined posture or an arched posture, a chair based on the present invention will provide comfortable support for the major part of the middle anatomical back throughout a relatively broad range of sitting postures from an upright one to a relatively greatly reclined one to an arched back (stretching) one.

In accordance with this invention, a chair may also include a second seat nested in and slidable forward and backward on the seat part of the unitary seat and lower back. Stops limit the extent of backward and forward movement of the second seat and, preferably, a spring restrains the second seat in its rearwardmost position. Coacting lengthwise guides constrain the second seat to move along a longitudinal axis and retain the second seat down on the seat part of the unitary seat and lower back.

In chairs having a movable second seat, the seat will automatically move within the range permitted by the stops to position conforming to the sitting posture of the person sitting in the chair. In an upright or stretching posture, the seat will stay all the way back; when the person reclines backward, the seat will move forward to an extent determined by how reclined the posture assumed is. Meanwhile, the upper back will articulate relative to the lower back in the manner described above. The movable second seat increases the comfort of the chair in reclined positions by supporting the thighs of the person somewhat more than chairs having a fixed seat. Nonetheless, the articulating upper back is considered the more important aspect of the improved institutional chairs disclosed herein.

The most important advantage of chairs which follow the present invention is, of course, a substantial improvement in comfort throughout a range of sitting postures which is afforded by the variable geometry of the back. This feature is, of course, known, per se, particularly in secretarial chairs, seating for automobiles, railcars and aircraft, various lounge chairs, and the institutional and office seating based on the inventions of the present inventor disclosed in the two patents referred to above. The present invention, however, provides this feature at an extremely low cost afforded by elimination of the need for a frame and by the use of relatively simple articulating linkages which can be mass produced relatively economically.

For a better understanding of the invention, reference may be made to the following description of exemplary embodiments taken in conjunction with the accompanying drawings.

DESCRIPTION OF EXEMPLARY EMBODIMENTS

Figure 1:
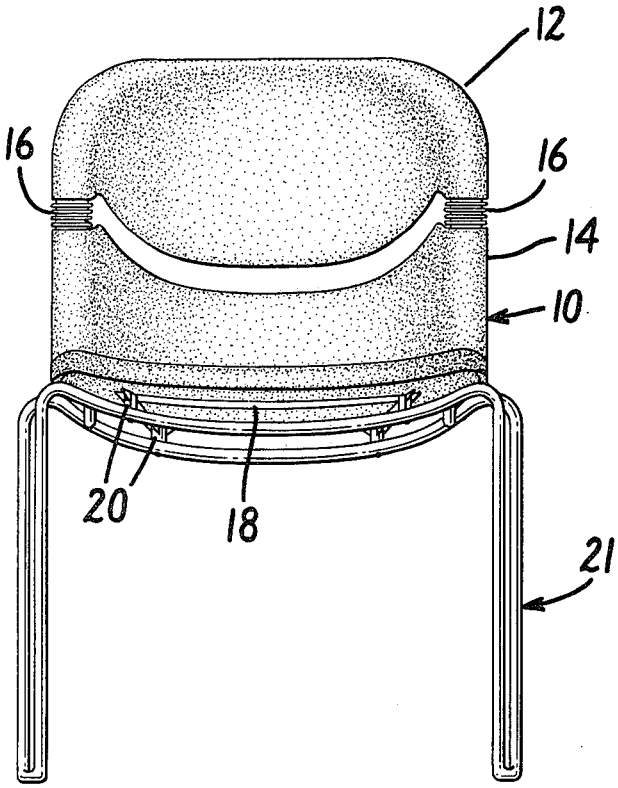
FIGS. 1 through 4 are front elevational, side elevational, top and bottom views, respectively, of one exemplary embodiment of the invention.
Figure 2:
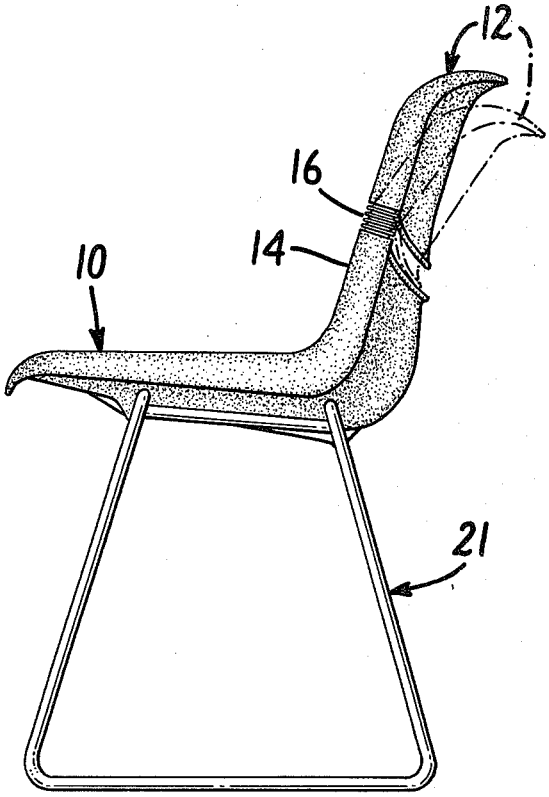
Figure 3:
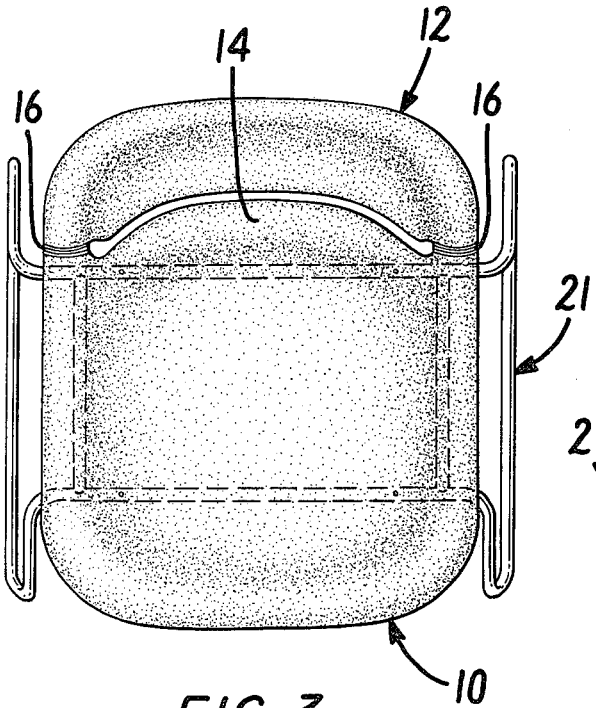
Figure 4:
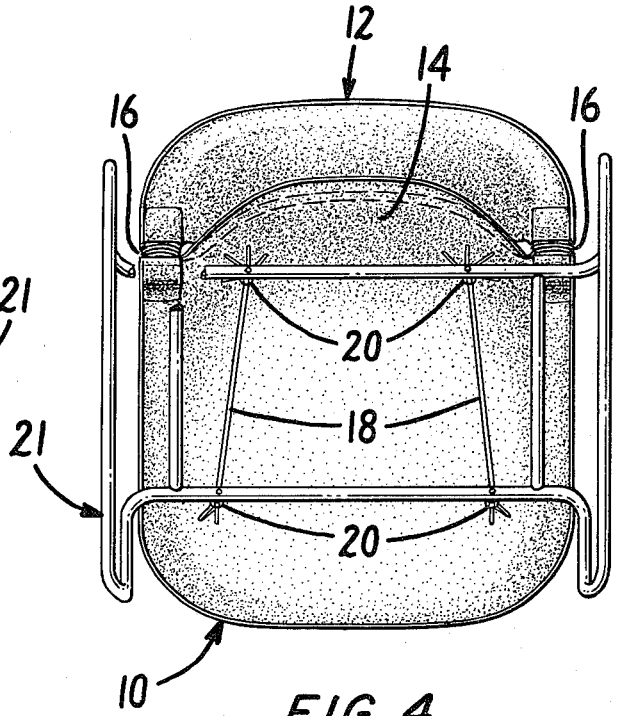
Figure 5:
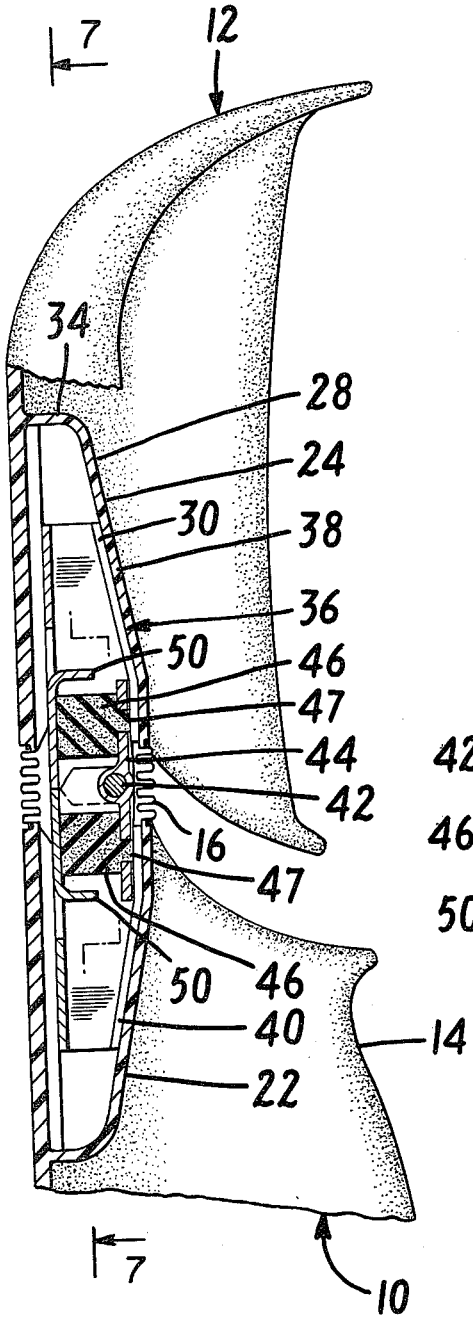
FIG. 5 is a side elevational view of the back of the chair of FIG. 1 with a portion broken away to show one form of suitable articulating linkage for mounting the upper back on the lower back.
Figure 6:
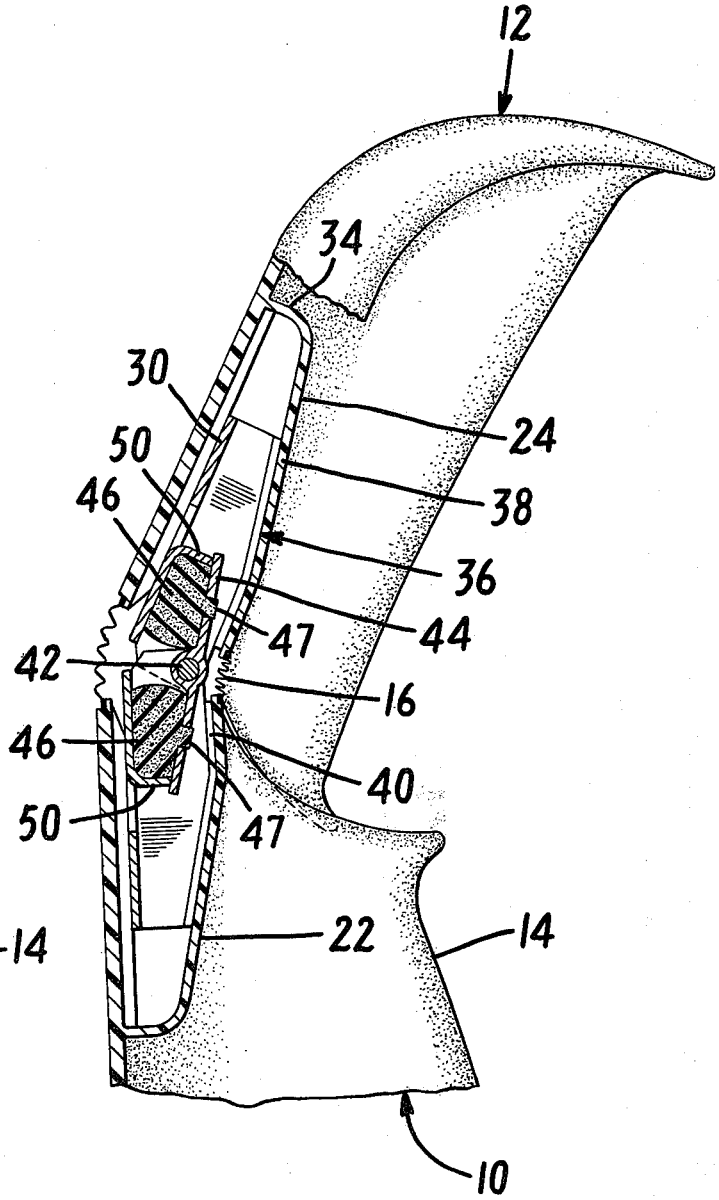
FIG. 6 is the same as FIG. 5 but shows the upper back tilted backward.
Figure 7:
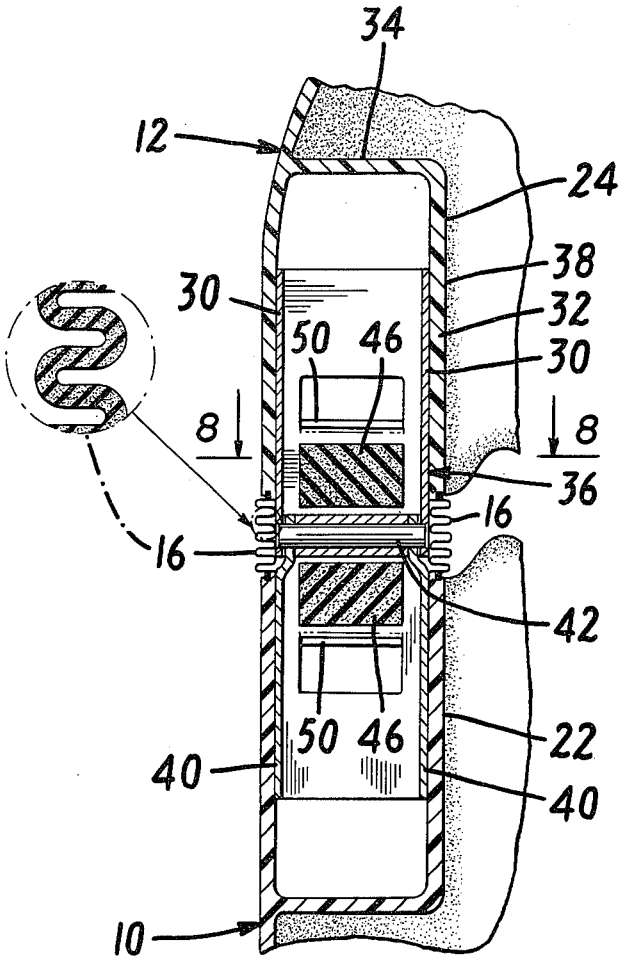
FIG. 7 is a partial rear view of the chair back with a portion broken away in section to reveal the articulating linkage shown in FIGS. 5 and 6.

The chair shown in FIGS. 1 to 4 comprises a unitary seat and lower back 10 and a separate upper back 12, both of which are contoured transversely and longitudinally for comfortable support of the posterior and back of an adult human sitting in the chair. (As mentioned above, the term "adult" is by no means intended to exclude chairs scaled down to youth or child sizes.) Each of the components 10 and 12 is formed, preferably by injection molding, from a rigid, high-impact strength plastic, such as polypropylene or an ABS. The upper back 12 is mounted on the lower back part 14 of the seat and lower back unit 10 by two suitable resilient articulating linkages, one of which is located at each side of the chair and each of which is enclosed in a bellows-like flexible extensible sleeve 16. Several preferred embodiments of articulating linkages are shown in the drawings and described below. The underside of the seat (see FIG. 4) has a series of stiffening ribs 18 and four small bosses 20 which receive screws by which any of a variety of forms of legs or suitable brackets for use with a pedestal or beam are secured to the chair. The legs 21 shown in FIGS. 1 to 4 are merely exemplary and form no part of the present invention. They are composed of steel tubing bent into the configuration shown, a configuration which permits stacking.

The transverse horizontal axis of articulation of the upper back 12 relative to the lower back part 14 is located generally at the center of the bellows 16, a location which is at the level of approximately the middle of the anatomical middle back of an adult human sitting in the chair. The lower edge of the upper back 12 is curved convexly in the transverse direction (as viewed from the front or back), thus to provide a height in the center part of the upper back which is generally coextensive with the major part of the middle back of an adult human, say from about the waist to the shoulder blades. Thus the upper back 12 provides good support for the back of a person sitting in the chair. The upper edge of the lower back is curved to match the lower edge of the upper back, leaving only a relatively small space of generally uniform width between the adjacent edges of the upper back 12 and lower back 14. The relative locations of the lower edge of the center part of the upper back and the axis of articulation of the upper back help to balance the forces on the upper back on either side of the axis of articulation and ensure that when the upper back tilts backward (see FIG. 2) the lower edge moves forwardly to help support the lower back of a person slumping or reclining in the chair.

The walls of the seat and lower back unit 10 and the upper back 12 are of generally uniform thickness, but may be made of increased thickness where required for strength. Stiffening ribs or flanges may be added as required. of the parts 10 and 12 is bounded by a peripheral flange which is, to some extent, an aesthetic feature but which also contributes strength and rigidity.

Four different forms of articulating linkages are shown in the drawings and are covered by the descriptions to follow. In every case, however, the articulating linkages are constructed to fit within complementary sockets 22 and 24 at each side of the lower back and upper back, respectively. The sockets open toward each other and generally are the same in size and shape in that they include a front wall 26 defined by the edges of a series of ribs (to save plastic and maintain uniform plastic wall thicknesses for better, faster molding and better finished contour while providing a contoured front and effectively flat rear face), a rear wall 28 which tapers away from the opening toward the front wall, side walls 30 and 32 and a top wall 34 or, in the case of the sockets in the lower back, a bottom wall.

Each of the four articulating linkages shown in the drawings (FIGS. 5 through 20 and 33 to 37) includes upper and lower generally tubular links which are generally similar to the extent that each includes a front wall, side walls and a rear wall (or flanges constituting a partial rear wall) which engage corresponding front, side and rear walls of the sockets. Notwithstanding the similarities, there are differences in detail among the specific links of the various articulated linkages, and different reference numbers are assigned to them. The foregoing general description is applicable to all of them and will not be repeated. The links are also similar insofar as they are made by cutting blanks from relatively heavy gauge steel and bending them into a generally tubular or box-like form. Each link is anchored in place in the socket by adhesive, by locking lugs or by suitable fasteners.

The resilient articulating linkage 36 shown in FIGS. 5 to 8 of the drawings is very similar to one described and shown in U.S. Pat. No. 4,157,203 (referred to above). It comprises an upper link 38 and a lower link 40 which are the same except that the upper edges of the side walls of the lower link are bent inward to be received in overlapping relation within the lower edges of the side walls of the upper link (see FIG. 7). An axle 42 joins the two links for articulation and carries a spring reaction plate 44 having leaves which extend up within the upper link and down within the lower link. Compression springs 46 in the form of bodies of a relatively stiff elastomer, such as neoprene or a polyurethane, are engaged under a moderate preload force between each leaf of the reaction plate 44 and the front wall of the respective link 38 or 40. The springs 46 react against the reaction plate and resiliently hold the upper back 12 in an upright position relative to the lower back by pressing against the front walls of the links. Each of the springs 46 is fastened to the reaction plate by bosses 47 that are force-fit into matching holes in the reaction plate. The limit upright position is established by contact between the flanges at the back of each link and the ends of the bosses 47, which project out from the back of the reaction plate and cushion and quiet contact at the upright stop position.

When a person sitting in the chair leans back with sufficient force to overcome the preload force in the springs 46 of the linkage, the springs yield and allow the upper back 12 to tilt backward relative to the lower back 10. The rearward limit is established by engagement between the spring reaction plate 44 and the free ends of tabs 50 partly cut and then bent back from the front walls of the links. When the backward force on the upper back is removed, the springs 44 restore the upper back to the upright position.

Figure 8:
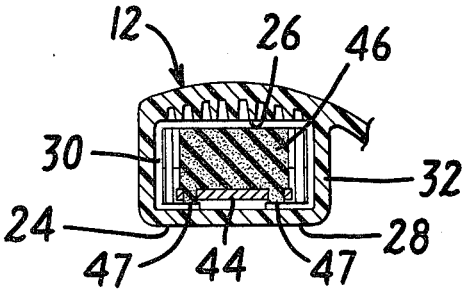
FIG. 8 is a fragmentary top cross-sectional view taken along the lines 8—8 of FIG. 7 and in the direction of the arrows.
Figure 9:
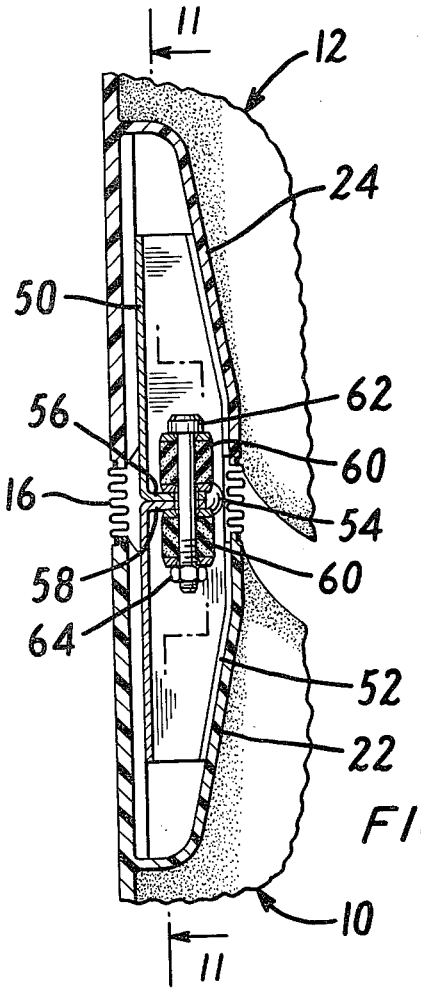
FIG. 9 is a side view in cross section taken just inside the near side of the chair back and showing another form of articulating linkage in the upright position.
Figure 10:
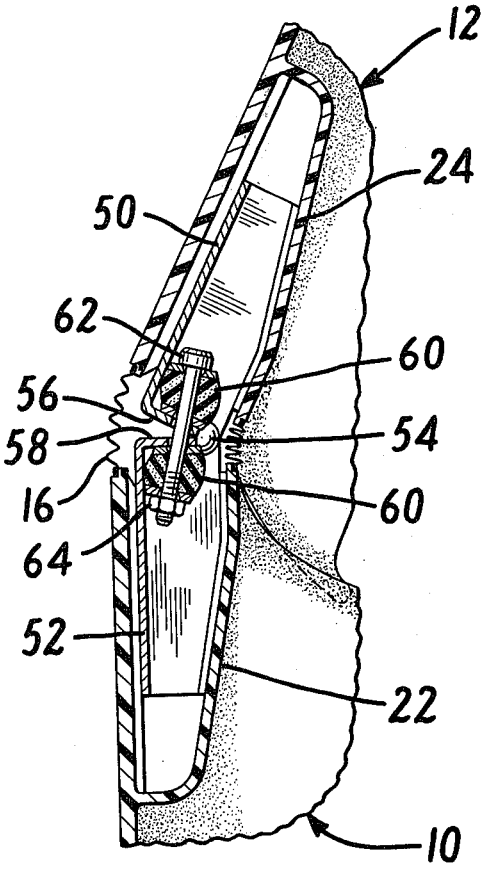
FIG. 10 is the same as FIG. 9 except that the upper back is tilted backward.
Figure 11:
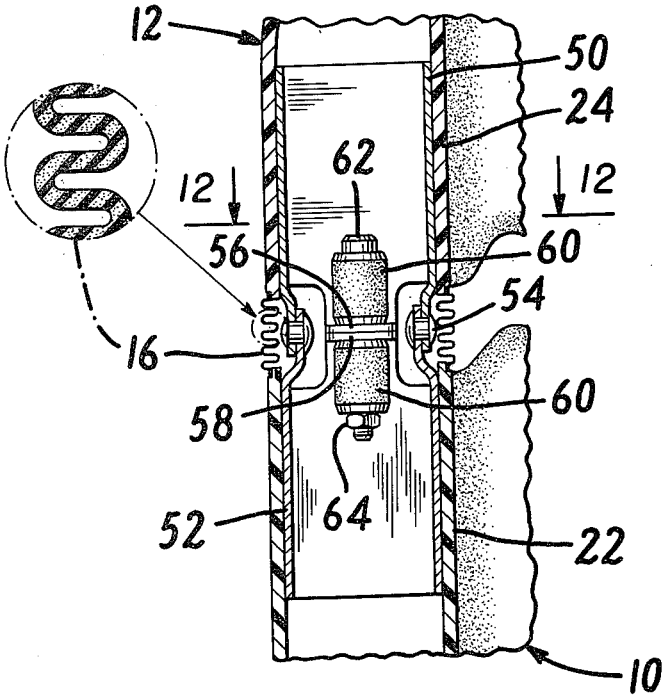
FIG. 11 is a fragmentary rear cross-sectional view of the articulating linkage shown in FIGS. 9 and 10.
Figure 12:
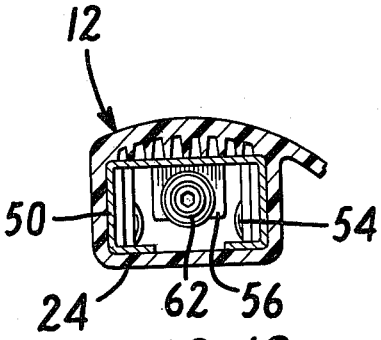
FIG. 12 is a fragmentary top cross-sectional view taken along the lines 12—12 of FIG. 11.
Figure 13:
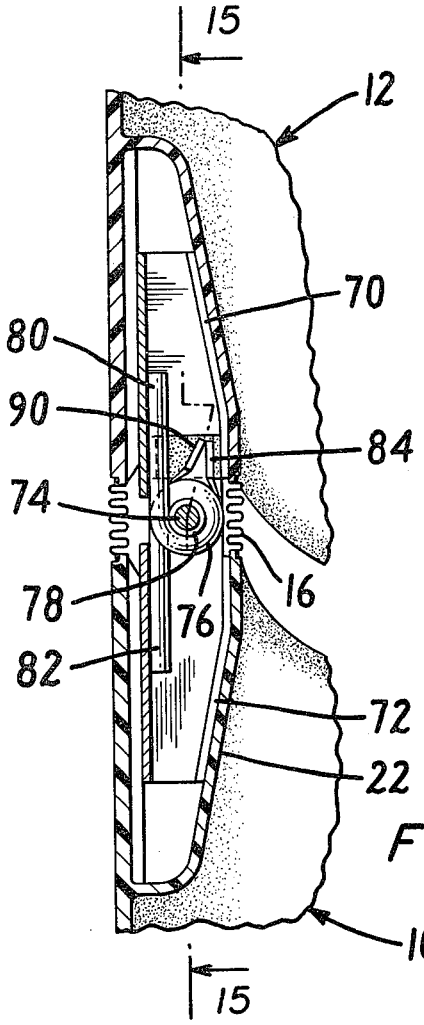
FIG. 13 is a partial side cross-sectional view showing another articulating linkage in the upright position.
Figure 14:
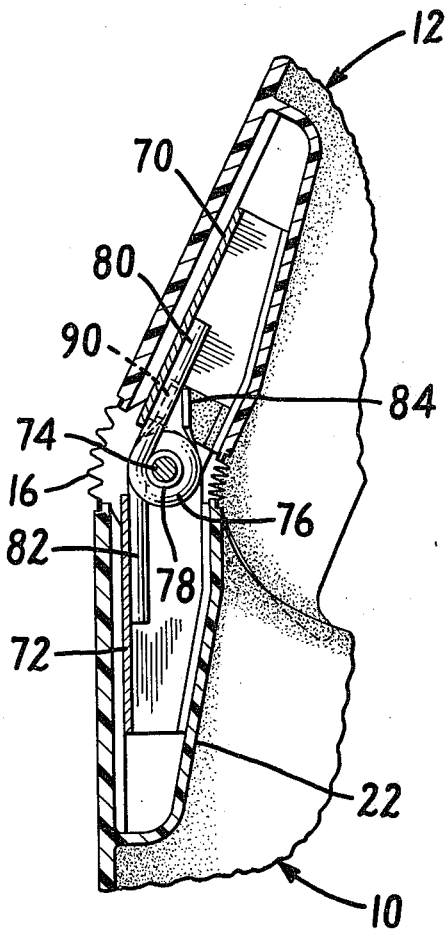
FIG. 14 is like FIG. 13, except it illustrates the upper back tilted backward.
Figure 15:
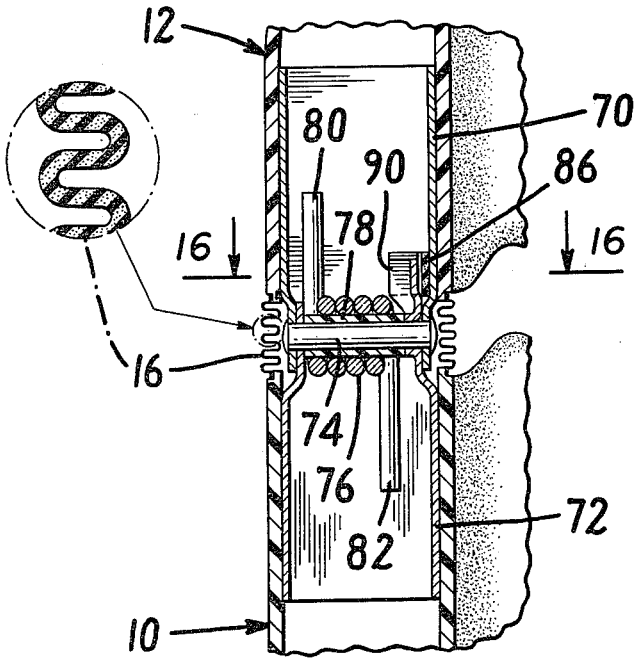
FIG. 15 is a rear cross-sectional view of the linkage shown in FIGS. 13 and 14 taken along the lines 15—15 of FIG. 13.
Figure 16:
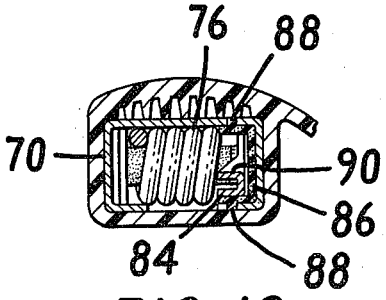
FIG. 16 is a fragmentary top cross-sectional view taken along the lines 16—16 of FIG. 15.
Figure 17:
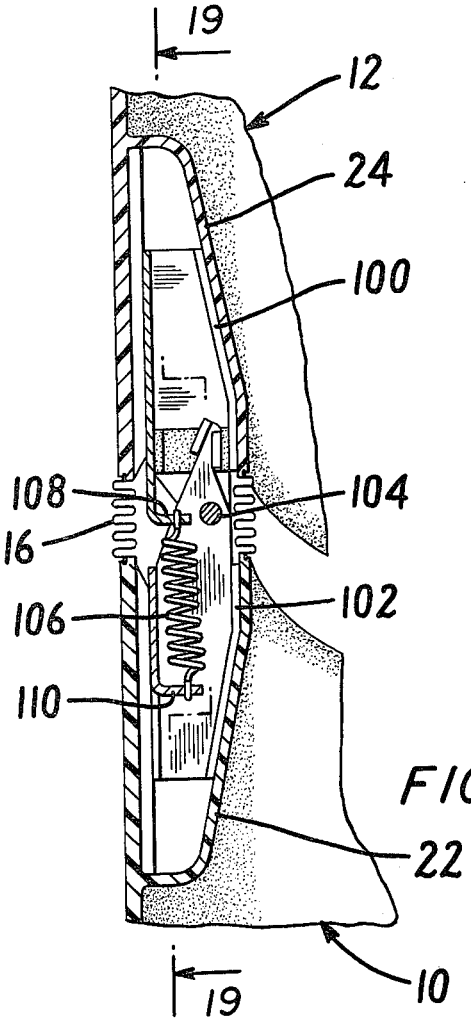
FIG. 17 is a partial side cross-sectional view of a chair having another articulating linkage, which is shown in the upright position.
Figure 18:
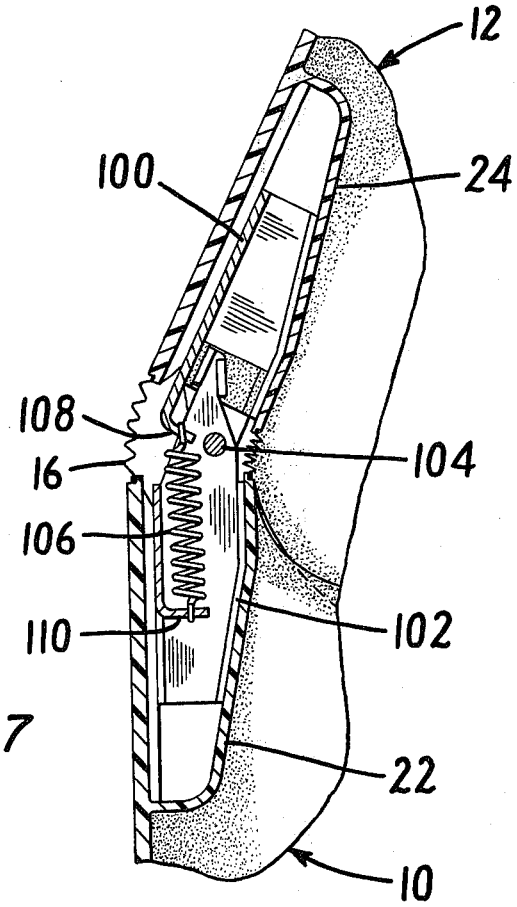
FIG. 18 is similar to FIG. 17, but it depicts the upper back in the tilted backward position.
Figure 19:
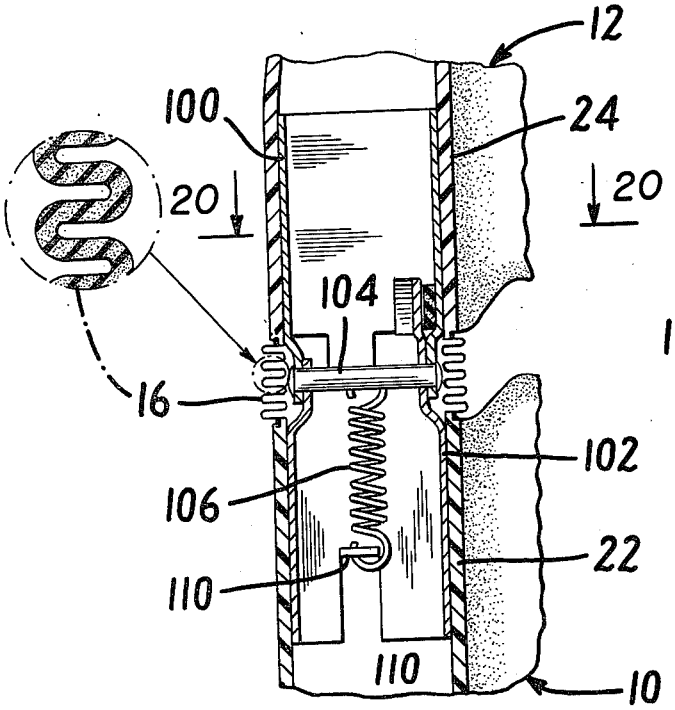
FIG. 19 is a fragmentary rear cross-sectional view taken along the lines 19—19 of FIG. 17.
Figure 20:
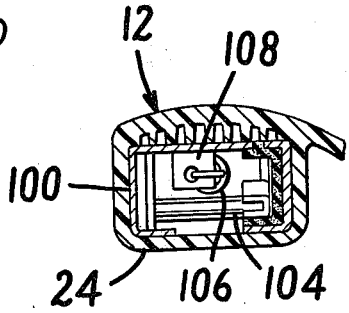
FIG. 20 is a fragmentary top cross-sectional view taken along the lines 20—20 of FIG. 19.

As mentioned above, the spaces between the openings of the sockets in the upper and lower back where parts of the articulating linkages are exposed are filled by tubular bellows-like flexible and extensible covers 16 shaped in transverse cross section to match the transverse cross-sectional profile of the perimeters of the sockets (see FIG. 8). As shown best by the enlarged fragmentary detail view in FIG. 7, the tubular covers 16 are corrugated. They are made of a resilient flexible polymeric material, such as vinyl nitrile or neoprene.

The articulating linkages shown in FIGS. 9 to 12 include upper and lower links 50 and 52 joined by rivets 54 (using a spacer to keep the rivets from locking the two parts so they cannot articulate) and include mating inwardly-extending flanges 56 and 58 bent in from the front walls where the links meet. Elastomer springs 60, which are backed up by washers at each end, are engaged between the faces of the flanges 56 and 58 remote from each other and in the case of the top spring 60 the head 62 of a bolt and in the case of the bottom spring a nut 64. The bolt passes through holes in the flanges and thus retains the springs in position. The springs are under a moderate preload which forces the flanges 56 and 58 toward each other and, therefore, yieldably restrain the upper back 12 in the upright position for comfortable support. When a backward force imposed on the upper back overcomes the preload force in the springs, the springs are compressed and allow the upper back to tilt backward (see FIG. 1). When the backward force on the upper back is removed, the springs again force the flanges back together. The limit of forward movement of the upper back relative to the lower back (i.e., the upright position of the upper back) is established by engagement between the adjacent faces of the flanges 56 and 58. The limit on backward tilting of the upper back is established by contact of the top and bottom washers of the spring assembly with the front walls of the two links (see FIG. 10).

The embodiments of FIGS. 5 to 8 and of FIGS. 9 to 12 share a common principle, namely the automatic balancing between the two spring elements of the compression forces. Thus the reaction plate 44 of the embodiment of FIGS. 5 to 8 automatically assumes an inclination relative to the axes of each of the links equal to about one-half of the angle of articulation to balance the spring forces. That relationship also applies to the embodiments of FIGS. 9 to 12 and FIGS. 33 to 37.

The articulating linkage shown in FIGS. 13 to 16 includes upper and lower links 70 and 72 joined by an axle 74 which passes through holes in overlapping portions of the side walls of the links. The upper back is normally held in an upright position by a moderately preloaded mousetrap type spring 76 which is coiled around a plastic sleeve 78 fitted over the axle 74 and has legs 80 and 82 that extend out and engage the front walls of the links 70 and 72. The upright position of the upper back is established by engagement between a lug 84 bent in from the upper edge of one side wall of the lower link 72 with an elastomeric, generally U-shaped cushion secured to the upper link by small bosses 88 force-fit into matching holes in the walls of the upper link (see FIG. 16). As the name given to it implies, the cushion 86 quiets and absorbs the energy of abrupt movements of the upper back to either of the limit positions. The rearward limit stops comprise a lug 90 bent in from the upper edge of one side wall of the lower link 72 and the front part of the cushion 86 (see the dotted lines in FIG. 14). The mode of operation of this embodiment requires no description.

The fourth form of articulating linkage shown in the drawings (FIGS. 17 to 20) has upper and lower links 100 and 102 which are joined for articulation by an axle 104 and are normally held in an upright position (FIG. 17) by a tension spring 106 installed under moderate tension between lugs 108 and 110 bent in from the front walls of the links 100 and 102. The arrangement of the stops (lugs on the upper edge of one side wall of the lower link 102) are the same as those of the embodiment of FIGS. 13 to 16 and described above—no additional description seems to be called for. A backward force on the upper back 12 sufficient to overcome the preload force in the spring 106 forces the upper back to articulate backwards about the axle 104, thus increasing the tension in the spring 106. The energy stored in the spring returns the upper back 12 to the upright position when the person returns to an upright position.

Figure 21:
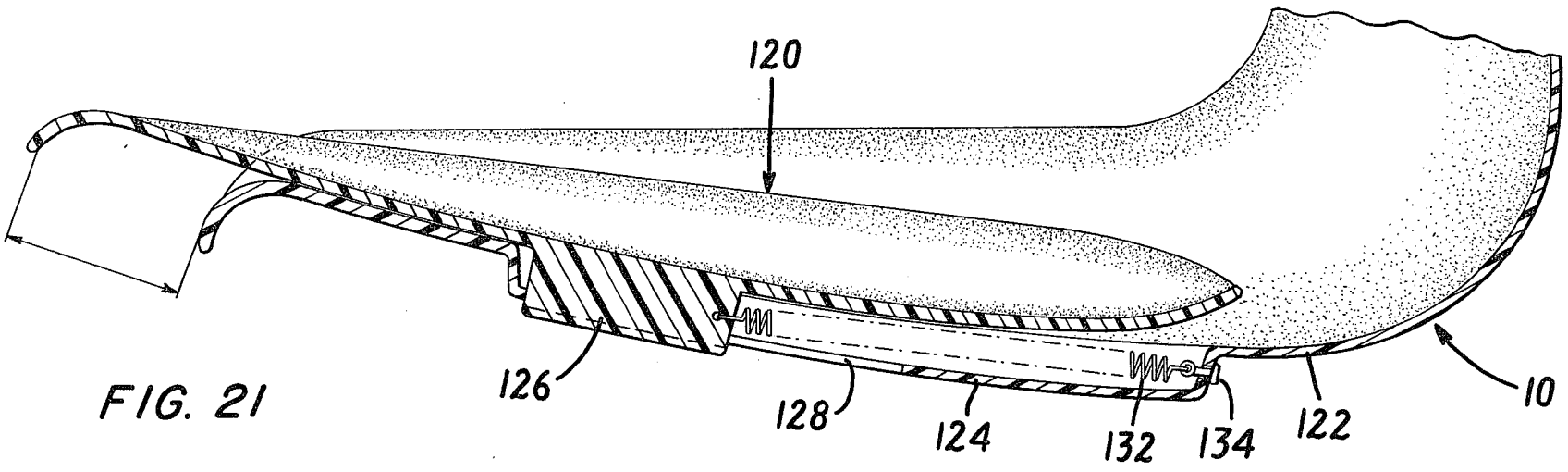
FIG. 21 is a side cross-sectional view taken along the center of the seat of a chair just like the one shown in FIGS. 1 through 4, except that it has a second, longitudinally movable seat (shown in the forward limit position)
Figure 22:
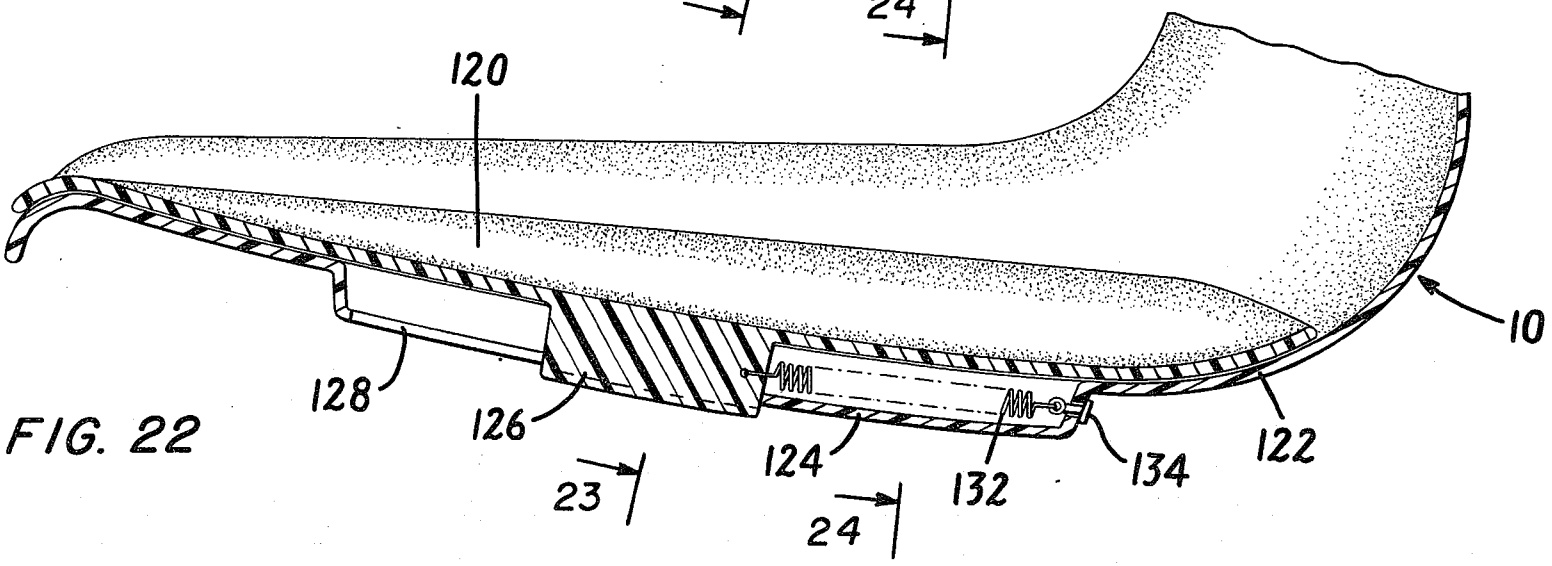
FIG. 22 is a side cross-sectional view of the seat shown in FIG. 21 and shows the movable second seat in the rearward limit position.
Figure 23:
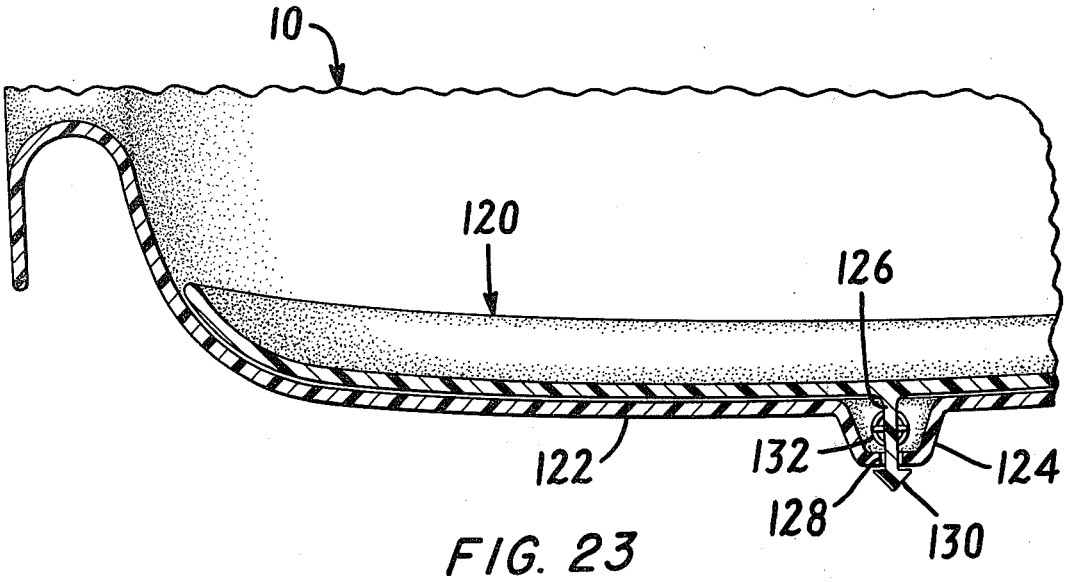
FIG. 23 is a partial cross-sectional view of the seat shown in FIGS. 21 and 22 taken along the lines 23—23 of FIG. 22.
Figure 24:
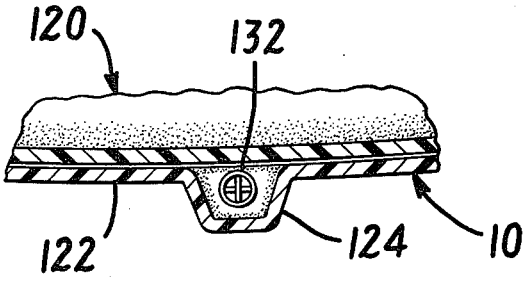
FIG. 24 is a partial cross-sectional view taken along the lines 24—24 of FIG. 22.
Figure 25:
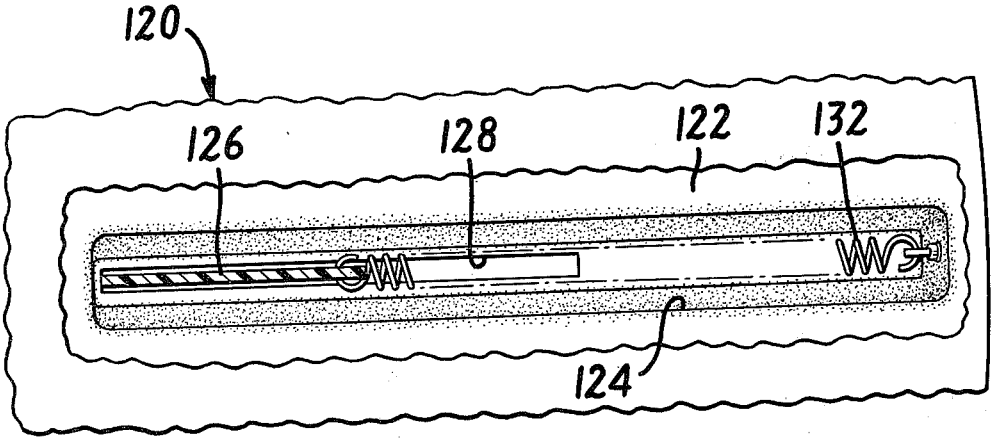
FIG. 25 is a fragmentary top view of the center part of the seat of FIG. 21 (in the forward position) with portions broken away to show the mounting and guide mechanism.

FIGS. 21 to 26 show the seat of a chair of the form described above, namely one having a unitary seat and lower back and an upper back mounted on the lower back for backward tilting, modified by the addition of a second seat 120 which nests in the seat part 122 of the unitary seat and lower back 10 and which is mounted and guided on the seat part 122 for movement between a rearward limit position (FIG. 22) and a forward or extended position (FIG. 21). In the embodiment of FIGS. 21 to 26 a narrow, elongated, depressed trough or channel 124 is molded into the seat part 122 of the unitary seat and lower back 10. The movable seat 120 has a vertical longitudinally-extending rib 126, the lower edge of which passes through a slot 128 in the front part of the lower wall of the channel 124. The upwardly facing shoulders of a bead 130 of V-shaped cross section on the lower edge of the rib 126 holds the movable seat 120 down on the seat part 122 of the unitary seat in the lower back 10. The wedge shape of the downwardly-facing part of the bead 130, however, permits the rib to be forced through the slot 128, mutually deforming the bead and the walls of the slot in the process. A tension spring 132 fastened at one end to the rib 126 and at the other end to a retaining hook 134 inserted at the back end of the channel 124 normally pulls the movable seat 120 to a rearward position (FIGS. 22 and 26) but allows the movable seat 120 automatically to slide forward when a person sitting in the chair slides his posterior forward to assume a reclined position (FIGS. 21 and 25). Forward movement or extension of the second seat 120 is stopped by engagement between the front edge of the rib 126 and the front edge of the slot 128 (FIG. 21), while rearward movement is stopped by engagement between the back edge of the rib 126 and the back edge of the slot 128. The rib and slot perform three functions—limiting the extent of forward and backward movement of the movable seat 120, guiding the seat along a longitudinal axis and holding the second seat down on the seat part of the unitary seat and lower back.

FIGS. 27 through 32 show another form of movable seat. The movable seat 140 includes a contoured plastic base 142, a thin layer of padding 144 and upholstery 146 bent under the edges of the perimeter of the plastic base 142 and stapled or glued in place. (The upper back of the chair may also be padded and upholstered.) A pair of laterally spaced-apart guides are molded into the base 142 of the movable seat, each guide being constituted by a generally L-shaped flange 148 projecting from the bottom of the base 142 (see FIG. 29). A series of lengthwise ribs 150 also project from the bottom of the base 142 and ride upon the upper surface of the seat part 152 of the unitary seat and lower back 10. A slot 154 extends forwardly from and opens to the guideway defined by the ribs 148 and is bounded by a peripheral flange 152.

Figure 26:
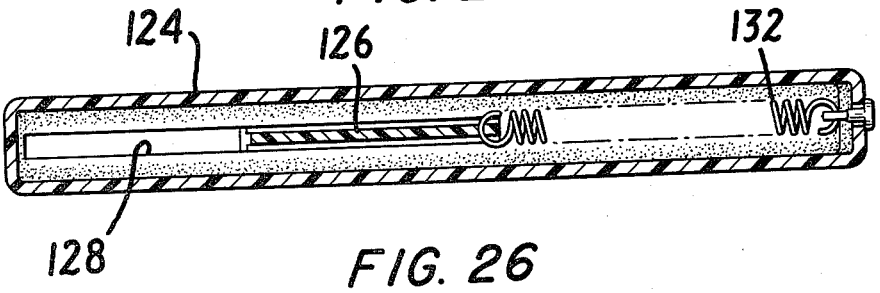
FIG. 26 is a cross-sectional view taken just below the main body of the movable second seat of FIGS. 21 and 22, and illustrates the movable seat in the rearward limit positon.
Figure 27:
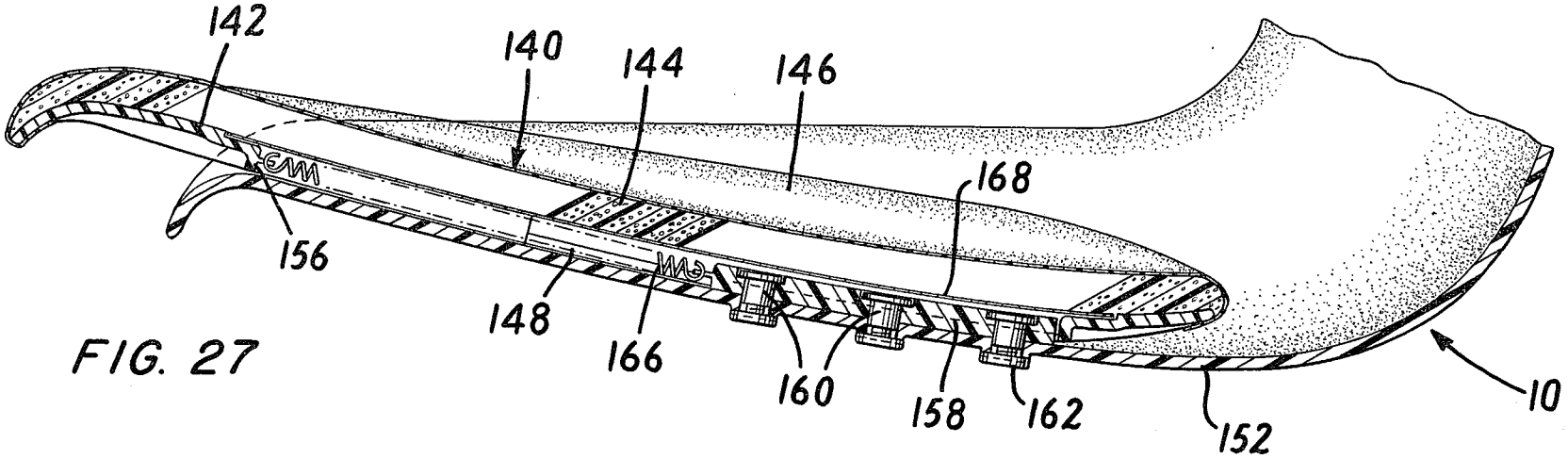
FIG. 27 is a side cross-sectional view taken along the medial longitudinal plane of a chair similar to that shown in FIGS. 1 to 4 but having a movable second seat constructed and mounted a bit differently from that shown in FIGS. 21 to 26—as shown in FIG. 27, the seat is in its forward limit position.
Figure 28:
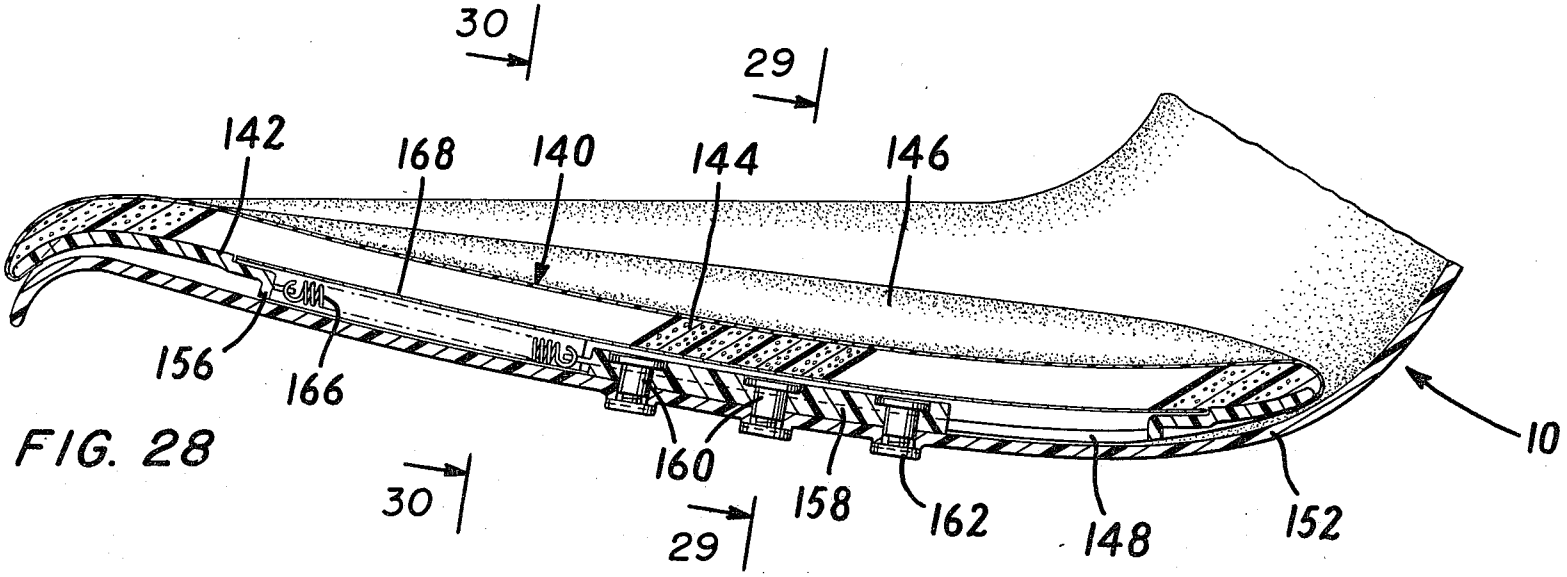
FIG. 28 is a side cross-sectional view similar to FIG. 27, but shows the seat in its rearward limit position.
Figure 29:
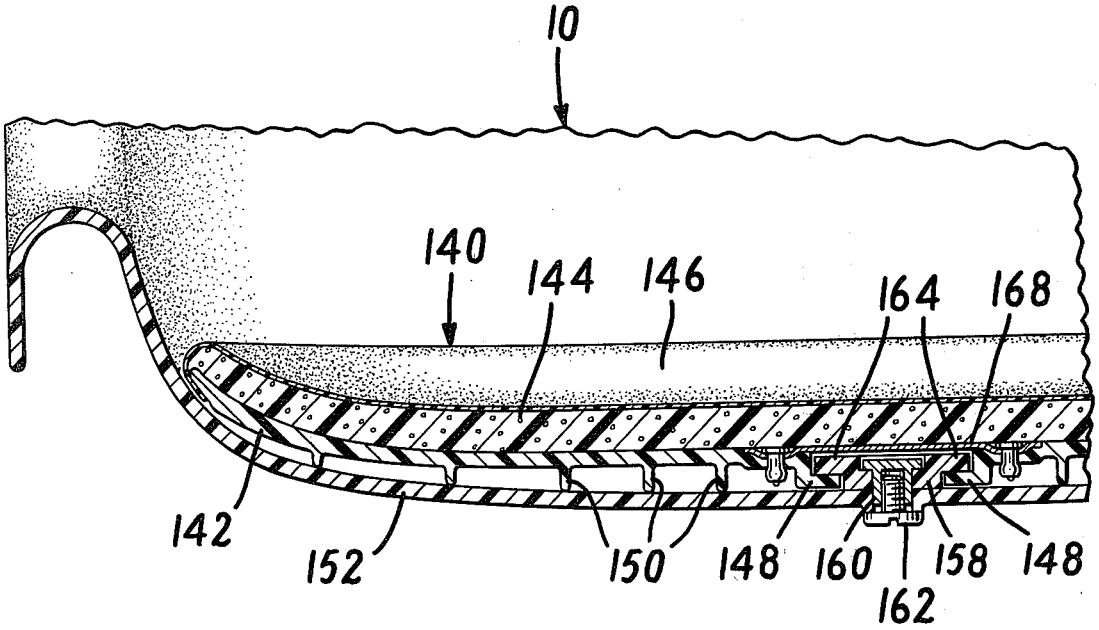
FIG. 29 is a partial cross-sectional view of the seat shown in FIGS. 27 and 28 taken along the lines 29—29 of FIG. 28 and in the direction of the arrows.
Figure 30:
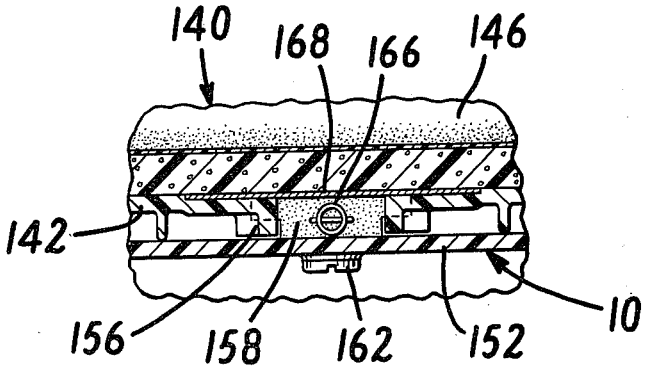
FIG. 30 is a fragmentary cross-sectional view taken along the lines 30—30 of FIG. 28.
Figures 31, 32:
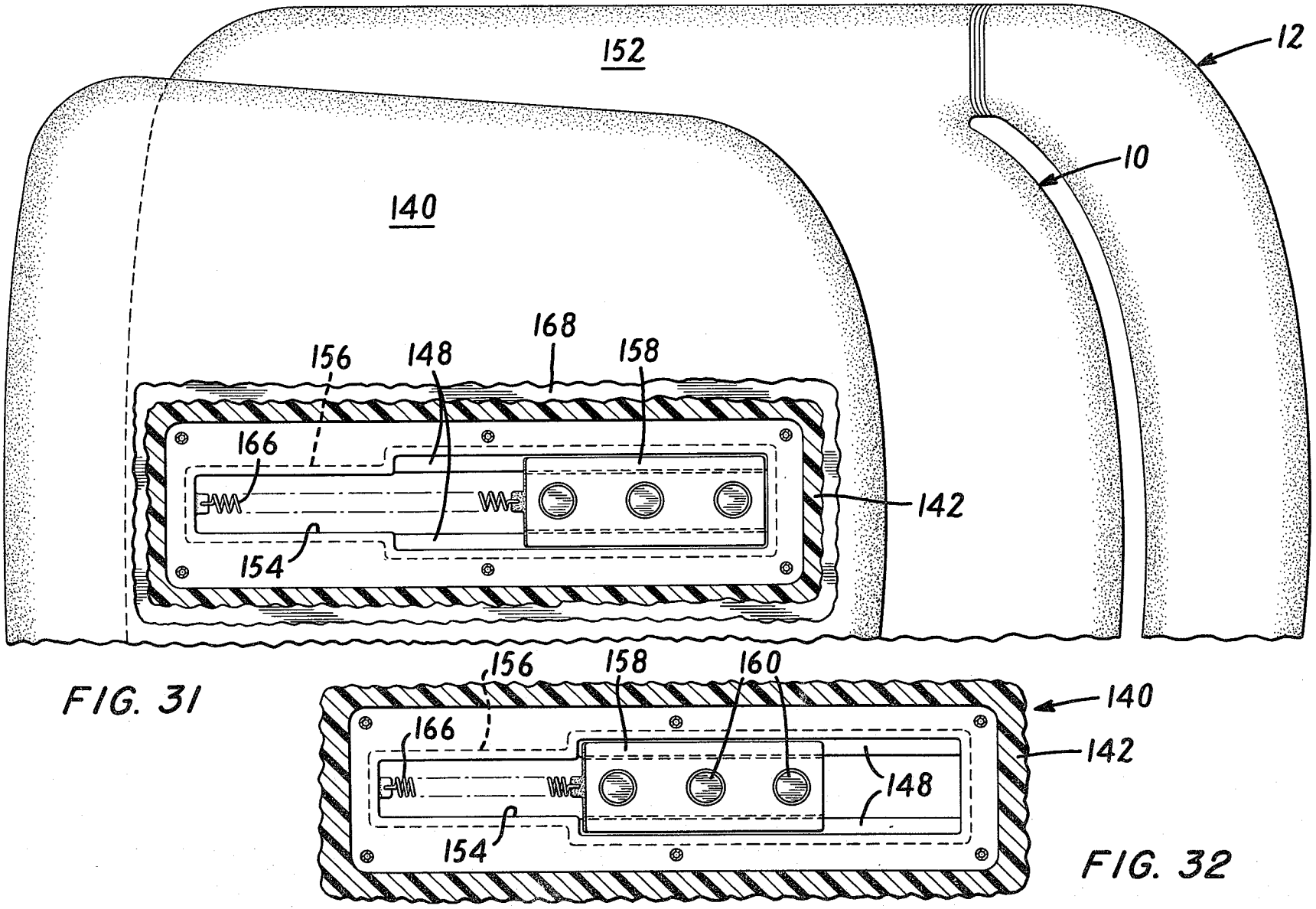
FIG. 31 is a partial top view of a chair having the seat construction of FIGS. 27 and 28 with portions broken away to show the mounting and guide mechanism for the second seat.
FIG. 32 is a fragmentary top cross-sectional view of the mounting and guide mechanism of the seat of FIGS. 27 to 31 and is like FIG. 31 except for showing the movable second seat in its rearward limit position.

A retainer plate 158, which is fastened by special nuts 160 and screws 162 on the upper surface of the seat part 152, holds the movable seat 140 down on the seat part 152 of the unitary seat and lower back 10 and guides it in lengthwise movement, by means of flanges 164 which extend out from either side of the retainer plate over the lengthwise, inwardly-extending parts of the flanges 148 along the underside of the movable seat 140. A tension spring 166 connected between the front end of the slot 154 and the retainer plate 158 pulls the seat into its rearward position (FIGS. 26, 28 and 32). When a person sitting in the chair slumps back and down into a reclined or relaxed position, the movable seat automatically slides forward on the seat part 152 (FIGS. 27 and 31). The limits of forward and backward movement of the movable seat are established by engagement between the ends of the guideway flanges 148 and the ends of the retainer plate 158.

A cover plate 168 riveted to the seat after installation of the spring 166 and the retainer 158 covers the hole in the center of the movable seat 140. After installing the cover, the padding and upholstery are added and the movable seat is then installed on the seat part 152 by setting it in place, positioning the retainer in register with the holes for the screws and installing the screws. A noteworthy feature of the chairs, which is exemplified by the aforementioned assembly procedure, is the great ease of assembly, a factor which contributes to the relatively low cost of chairs embodying the present invention.

In the two forms of chairs having movable seats (FIGS. 21 through 32), the seat part of the unitary seat and back and the movable seat have complementary surfaces in sliding engagement which are curved in the longitudinal direction. Accordingly, as the movable seat moves forward, its rake increases, the increased rake enhancing the comfort of the chair in reclined or relaxed sitting postures.

FIGS. 33 to 36 illustrate another form of articulating linkage for mounting the upper back 12 on the lower back part 14 of the seat and lower back unit 10. This embodiment is very similar to the articulating linkages described and shown in U.S. Pat. No. 4,157,203 (previously referred to) and to the linkage illustrated in FIGS. 5 to 8 and described above, but also includes a number of desirable refinements. The articulating linkage comprises a lower link 170 which is received in the socket 22 of the lower back part 14 of the seat and lower back unit 10 and an upper link 172 which is received in the socket 24 on the side of the upper back 12. The two links 170 and 172 are identical, which represents a cost advantage by reducing the number of different parts required for the linkage. Because they are identical, only the lower link 170 will be described in detail.

The link 170 comprises a U-shaped front part 174 having a pair of side wall portions **174*b* and 174*c*. A generally semicircular tab portion 176*a*, 176*b* extends from the upper end of the respective side walls 174*c* and 174*b*. Each tab has a hole 178 punched out and then stamped to leave a small annular flange. The tab 176*b* is offset inwardly from the larger part of the wall 174*b*, thus allowing the tabs on the upper and lower links to fit together in the manner shown clearly in FIG. 35 with the holes in register and the tabs overlapping (see FIG. 37). A pivot pin 180** passes through the four registering holes and connects the two links for articulation about the axis of the pin.

The front wall portion **174*a* of the link has a stamped-out two-step flange 181 which projects inwardly and provides retaining seats for a smaller inner spring 182 and a larger outer spring 184. Small inwardly extending projections, which are not visible in the drawings, are embossed near the rearward edge of each side wall 174*b* and 174*c* of the front part 174**.

The link 170 also has a back part 186 which includes a back wall **186*a* and a pair of side flanges 186*b* and 186*c* which extend forward from the lower end partway up the overall length of the link and fit inside the lower rearward portions of the side walls 174***b* and 174*c* of the front part of the link. Each side flange of the back part 186 has a number of dimples 188 embossed in its outer face into which the aforementioned small projections on the side walls of the front part fit. The matching projections and dimples hold the front and back parts 174 and 186 of the link together, but the two parts can, of course, be joined by rivets or other fasteners or welded together.

The back wall 186*a* has two small tabs 190 and 192 cut out along top and side edges and then pushed out to provide upwardly facing edges or shoulders which are received in recesses which have downwardly facing shoulders molded into the socket 22 of the lower back part 14.

Figure 33:
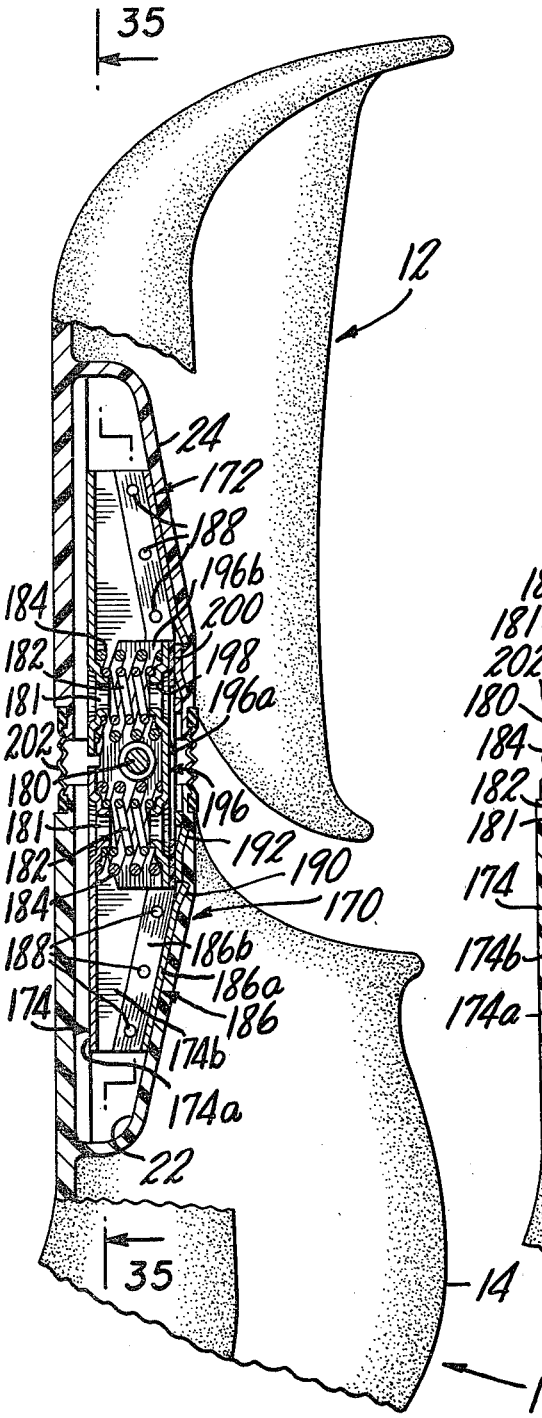
FIG. 33 is a side view in cross section taken just inside the near side of the chair back and illustrating another articulating linkage with the upper back in the upright position.
Figure 34:
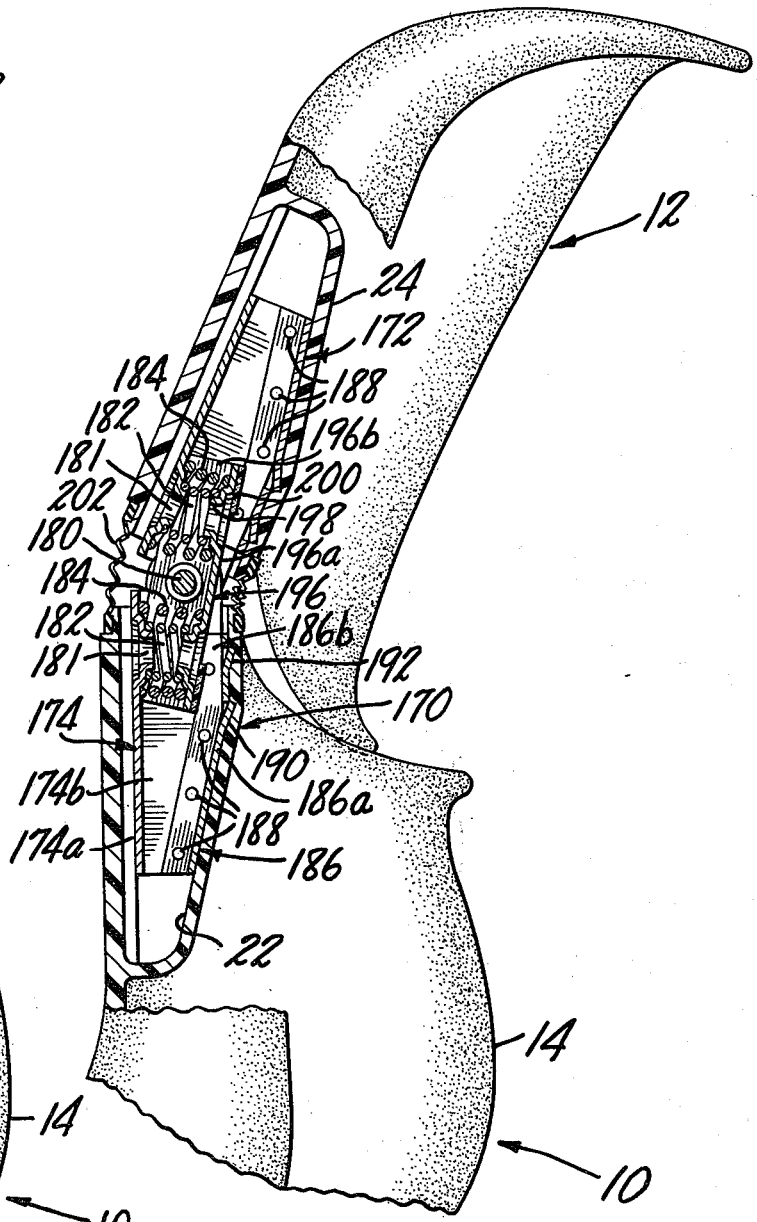
FIG. 34 is a view similar to FIG. 3 except that the upper back is tilted backward.
Figure 35:
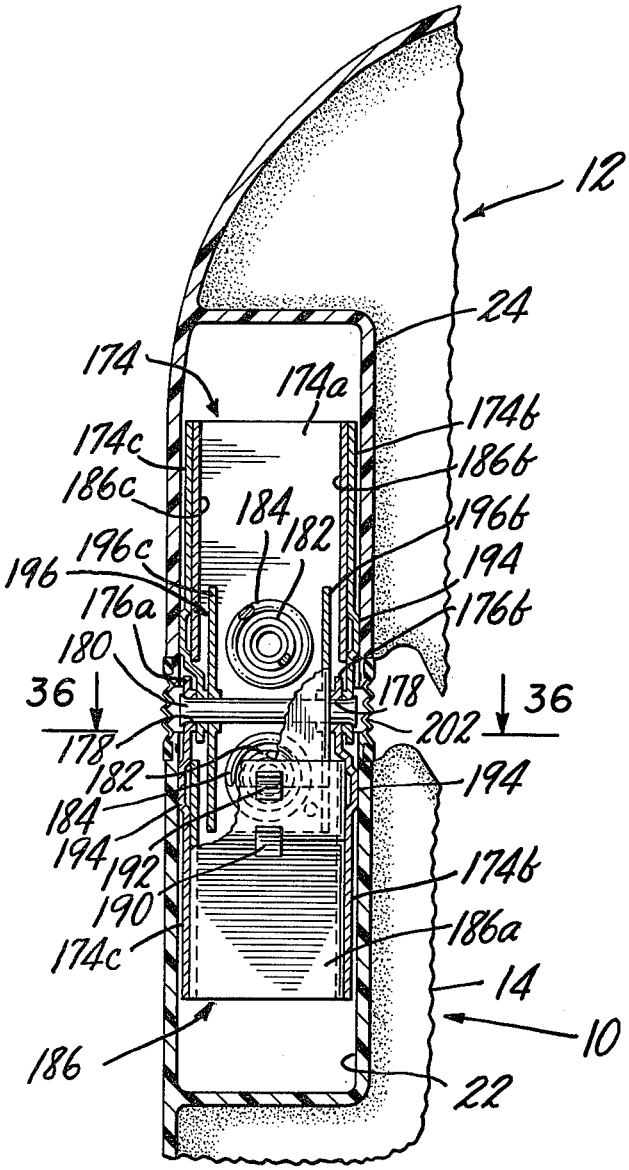
FIG. 35 is a fragmentary rear cross-sectional view taken from the rear of the left side of the chair back shown in FIGS. 33 and 34.
Figure 37:
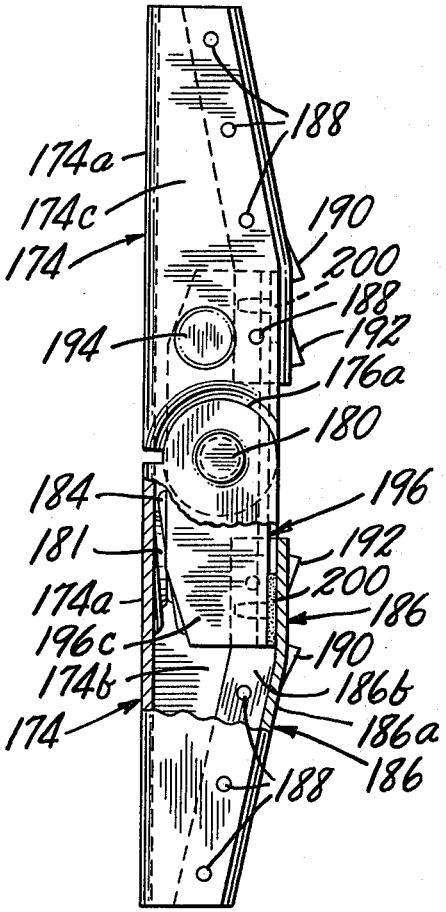
FIG. 37 is a side elevational view of the articulating linkage of FIGS. 33 to 36, with portions being broken away.
Figure 36:
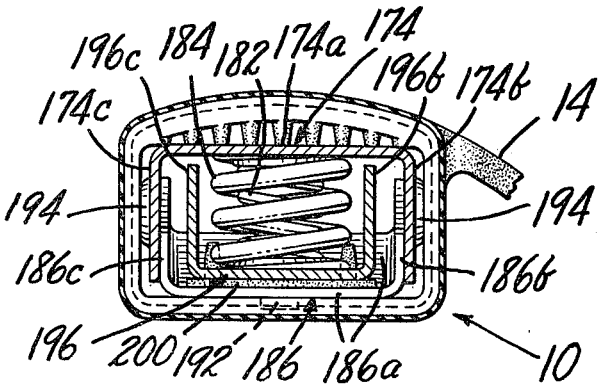
FIG. 36 is a fragmentary top cross-sectional view taken along the lines 36—36 of FIG. 35.

The link 170 is installed in the socket 22 by merely forcing it down; the wall of the socket deforms resiliently to allow the tabs 190 and 192 to enter the socket and ultimately snap into locking position in the corresponding notches in the socket (see FIG. 33). Installation of the link in the socket is facilitated by the provision of a small outwardly extending projection 194 embossed in each side wall 174*b* and 174*c* of the front part; the projections 194 hold the link firmly in place laterally while leaving a lateral clearance between the outer faces of the side walls of the link and the inner faces of the side walls of the socket, and the clearance keeps the link from binding as it is pushed into place.

The linkage further comprises a spring reaction member 196 which includes a back wall 196*a* and a pair of side flanges 196*b* and 196*c*. Each side flange has a hole which receives the pivot pin, the spring reaction member being pivotably mounted on the pivot pin. The back wall 196*a* has upper and lower two-step flanges 198 identical to those in the front walls of the links which provide seats for and retain the back ends of the springs 182 and 184.

The linkage is assembled with the two sets of springs compressed so that they exert a force between the spring reaction member and each link. It goes without saying that the size and number of springs used in the linkage depends upon the desired spring force for restraining the upper back in an upright position, but four relatively small springs are likely to have a longer life than two relatively large springs which produce the same force. The upright position of the upper back is established by upper and lower stops 200, preferably relatively hard plastic or rubber plates, suitably mounted on the back wall of the reaction member 196. The plates cushion and quiet force restoration of the upper back to the upright position when someone sitting in the seat abruptly releases the upper back when it is in the rearward tilted position.

When a person sitting in the chair stretches back or slumps back, the springs 182 and 184 yield and allow the upper back 12 to pivot about the axis of the pivot pin of the two linkages. The spring force is balanced between the upper and lower sets of springs due to the relative pivotal movement of each link with respect to the spring backup member (FIG. 34), and both sets of springs, of course, contribute substantially equally to the total force which resists rearward tilting of the upper back. The limit of rearward tilting of the upper back is established by stops constituted by the upper and lower, obliquely related front edges of the side flanges 196*b* and 196*c* of the spring reaction member with the front walls 174*a* of the two links which engage when the upper back is tilted fully back.

As in the other embodiments shown in the drawings, the space between the two links of the linkage is concealed and protected by an extensible bellows-like sleeve 202. Alternatively, the sockets can have overlapping, telescoping extensions.

The above-described embodiments of the invention are merely exemplary and are susceptible of numerous variations and modifications without departing from the spirit and scope of the invention. All such variations and modifications are intended to be included within the scope of the present invention as defined in the appended claims.

I claim:

1. A chair comprising a unitary seat and lower back, an upper back, the seat and lower back and the upper back being contoured longitudinally and transversely to conform generally to the anatomical shapes of the parts of a person sitting in the chair which are supported by the chair, and the lower back and upper back having complementary sockets at each side opening toward each other, and a resilient articulating linkage received in each complementary pair of sockets and mounting the lower back on the upper back for articulation between a resiliently restrained relatively upright position and a backward tilted position about a transverse horizontal axis at a height above the seat corresponding to about the middle of the anatomical back of a person sitting in the chair, at least the medial portion of the upper back being located substantially below the axis about which the upper back articulates, so that the upper back is vertically coextensive with and supports the major part of the anatomical middle back of a person sitting in the chair from about the waist to about the shoulder blades and the lower medial portion thereof shifts forward when the upper back articulates backward, and each articulating linkage including an upper tubular link and a lower tubular link, each such link having a front wall and a back wall, an axle joining the links for articulation, a spring reaction plate pivotably carried by the axle, and having a leg received within each link, compression springs engaged under compression between the front wall of each link and the respective leg of the spring reaction plate and urging the links about the axle in a direction toward the relatively upright position of the upper back and stop means for establishing the upright position and the full backward tilted position of the upper back.

2. A chair comprising a unitary seat and lower back, an upper back, the seat and lower back and the upper back being contoured longitudinally and transversely to conform generally to the anatomical shapes of the parts of a person sitting in the chair which are supported by the chair, and the lower back and upper back having complementary sockets at each side opening toward each other, a resilient articulating linkage received in each complementary pair of sockets and mounting the upper back on the lower back for articulation between a resiliently restrained relatively upright position and a backward tilted position about a transverse horizontal axis at a height above the seat corresponding to about the middle of the anatomical back of a person sitting in the chair, at least the medial portion of the upper back being located substantially below the axis about which the upper back articulates so that the upper back is vertically coextensive with and supports the major part of the anatomical middle back of a person sitting in the chair from about the waist to about the shoulder blades and the lower medial portion thereof shifts forward when the upper back articulates backward, and each articulating linkage including an upper link and a lower link, means joining the links for articulation about an axis, spring means resiliently urging the links about the axis in a direction toward the relatively upright position of the upper back and stop means for establishing the upright position and the full backward tilted position of the upper back, the links including front walls having complementary rearwardly projecting flanges, and the spring means consisting of compression springs engaged between the surfaces of the flanges remote from each other and spring retainers joined to each other and compressing the springs against the flanges so that the springs urge the flanges toward each other and the links toward the upright position.

3. A chair comprising a unitary seat and lower back, an upper back, the seat and lower back and the upper back being contoured longitudinally and transversely to conform generally to the anatomical shapes of the parts of a person sitting in the chair which are supported by the chair, and the lower back and upper back having complementary sockets at each side opening toward each other, a resilient articulating linkage received in each complementary pair of sockets and mounting the upper back on the lower back for articulation between a resiliently restrained relatively upright position and a backward tilted position about a transverse horizontal axis at a height above the seat corresponding to about the middle of the anatomical back of a person sitting in the chair, at least the medial portion of the upper back being located substantially below the axis about which the upper back articulates so that the upper back is vertically coextensive with and supports the major part of the anatomical middle back of a person sitting in the chair from about the waist to about the shoulder blades and the lower medial portion thereof shifts forward when the upper back articulates backward, and each articulating linkage including an upper link and a lower link, means joining the links for articulation about an axis, spring means resiliently urging the links about the axis in a direction toward the relatively upright position of the upper back and stop means for establishing the upright position and the full backward tilted position of the upper back, the links including front walls and the spring means consisting of a mousetrap type torsion spring having legs engaging the front walls of the links and mounted on an axle which joins the links, and the links including side walls which partly overlap and the stop means consisting of lugs on the side wall of one link, one of which engages the front wall of the other link to establish the upright position and the other of which engages a rear wall on the other link to establish the full backward tilted position.

4. A chair comprising a unitary seat and lower back, an upper back, the seat and lower back and the upper back being contoured longitudinally and transversely to conform generally to the anatomical shapes of the parts of a person sitting in the chair which are supported by the chair, and the lower back and upper back having complementary sockets at each side opening toward each other, a resilient articulating linkage received in each complementary pair of sockets and mounting the upper back on the lower back for articulation between a resiliently restrained relatively upright position and a backward tilted position about a transverse horizontal axis at a height above the seat corresponding to about the middle of the anatomical back of a person sitting in the chair, at least the medial portion of the upper back being located substantially below the axis about which the upper back articulates so that the upper back is vertically coextensive with and supports the major part of the anatomical middle back of a person sitting in the chair from about the waist to about the shoulder blades and the lower medial portion thereof shifts forward when the upper back articulates backward, and each articulating linkage including an upper link and a lower link, means joining the links for articulation about an axis, spring means resiliently urging the links about the axis in a direction toward the relatively upright position of the upper back and stop means for establishing the upright position and the full backward tilted position of the upper back, the links including front walls and the spring means being a tension spring connected under tension between the respective front walls, and the links including side walls which partly overlap and the stop means consisting of lugs on the side wall of one link, one of which engages the front wall of the other link to establish the upright position and the other of which engages a rear wall on the other link to establish the full backward tilted position.

5. A chair comprising a unitary seat and lower back, an upper back, the seat and lower back and the upper back being contoured longitudinally and transversely to conform generally to the anatomical shapes of the parts of a person sitting in the chair which are supported by the chair, and the lower back and upper back having complementary sockets at each side opening toward each other, a resilient articulating linkage received in each complementary pair of sockets and mounting the upper back on the lower back for articulation between a resiliently restrained relatively upright position and a backward tilted position about a transverse horizontal axis at a height above the seat corresponding to about the middle of the anatomical back of a person sitting in the chair, at least the medial portion of the upper back being located substantially below the axis about which the upper back articulates so that the upper back is vertically coextensive with and supports the major part of the anatomical middle back of a person sitting in the chair from about the waist to about the shoulder blades and the lower medial portion thereof shifts forward when the upper back articulates backward, and each articulating linkage including an upper link and a lower link, means joining the links for articulation about an axis, spring means resiliently urging the links about the axis in a direction toward the relatively upright position of the upper back and stop means for establishing the upright position and the full backward tilted position of the upper back, a second seat supported on the seat portion of the unitary seat and lower back for forward and backward movement, means limiting the extent of such movement, a spring urging the second seat to its rearward-most position, coacting guides on the seat portion and the second seat constraining the second seat to move along a longitudinal axis of the seat portion, the guides including transversely spaced-apart flanges on the underside of the second seat and a boss on the upper side of the first seat, the boss being undercut along its lateral edges and the flanges having inturned ribs received in the undercuts to hold the second seat down on the first seat, as well as guide it longitudinally.

6. A chair comprising a unitary seat and lower back, an upper back, the seat and lower back and the upper back being contoured longitudinally and transversely to conform generally to the anatomical shapes of the parts of a person sitting in the chair which are supported by the chair, and the lower back and upper back having complementary sockets at each side opening toward each other, a resilient articulating linkage received in each complementary pair of sockets and mounting the upper back on the lower back for articulation between a resiliently restrained relatively upright position and a backward tilted position about a transverse horizontal axis at a height above the seat corresponding to about the middle of the anatomical back of a person sitting in the chair, at least the medial portion of the upper back being located substantially below the axis about which the upper back articulates so that the upper back is vertically coextensive with and supports the major part of the anatomical middle back of a person sitting in the chair from about the waist to about the shoulder blades and the lower medial portion thereof shifts forward when the upper back articulates backward, and each articulating linkage including an upper link and a lower link, means joining the links for articulation about an axis, spring means resiliently urging the links about the axis in a direction toward the relatively upright position of the upper back and stop means for establishing the upright position and the full backward tilted position of the upper back, a second seat supported on the seat portion of the unitary seat and lower back for forward and backward movement, means limiting the extent of such movement, a spring urging the second seat to its rearward-most position, coacting guides on the seat portion and second seat constraining the second seat to move along a longitudinal axis of the seat portion, the guides including an upwardly open elongated longitudinal channel on the seat portion, the channel having a lengthwise slot, and an elongated longitudinal rib extending down from the underside of the second seat through the slot in the channel, the rib having along its lower edge a bead which is wider than the slot and holds the second seat down on the first seat.

7. A chair according to any of claims 1, 2, 3, 4, 5 and 6, wherein both the unitary seat and lower back and the upper back include one-piece bodies of a substantially rigid high-impact strength polymeric material.

8. A chair according to claim 2 wherein the stop means consists of the facing surfaces of the flanges which engage in the upright position, and parts of the spring retainers which engage the back faces of the front walls of the links in the backward tilted position.

9. A chair according to claim 1 wherein the socket openings are spaced apart and a flexible extensible tubing connects the openings to conceal and protect the otherwise exposed parts of the articulating linkage.

10. A chair according to claim 1 wherein the springs are metal coil springs.

11. A chair according to claim 1 wherein the spring reaction plate is channel-shaped in end profile and includes side flanges extending toward the front walls of the upper and lower links.

12. A chair according to claim 11 wherein the stop means in the backward tilted position includes angularly related front edge portions on the side flanges of the reaction plate located to engage the front walls of the respective upper and lower links.

13. A chair according to claim 1 wherein the stop means in the upright position of the upper back consists of mutually engaging surfaces of the spring reaction plate and the back walls of the links.

14. A chair according to claim 13 wherein there is cushion means interposed between the backward stop means surfaces of the reaction plate and the links to quiet the contact when the springs restore the upper back to upright position.

15. A chair according to claim 1 wherein each socket includes on an internal surface a recess defining an upwardly facing locking shoulder, and a corresponding wall of each link includes a projecting lug having a downwardly facing edge which engages the locking shoulder and secures the link in the socket.

16. A chair according to claim 1 wherein the upper and lower links are identical and each includes a side wall portion having an offset part that fits inside the opposite side wall portion of the other link adjacent the axle.

17. A chair according to claim 5 wherein the second seat includes a one-piece body of a rigid high-impact strength polymeric material.

18. A chair according to claim 6 wherein the slot is longer than the rib, and the extent of forward and backward movement is limited by engagement of the ends of the rib with the ends of the slot.

* * * * *

UNITED STATES PATENT AND TRADEMARK OFFICE

CERTIFICATE OF CORRECTION

PATENT NO. : 4,333,683
DATED : June 8, 1982
INVENTOR(S) : Emilio Ambasz

It is certified that error appears in the above-identified patent and that said Letters Patent are hereby corrected as shown below:

Column 6, line 51, after "required." insert --Each--; Column 12, lines 22 and 23, delete "mounting the lower back on the upper back" and insert --mounting the upper back on the lower back--; Column 16, line 38, after "claim 5" insert --or 6--.

Signed and Sealed this

*Twenty-fourth* Day of *May 1983*

[SEAL]

*Attest:*

DONALD J. QUIGG

*Attesting Officer* *Acting Commissioner of Patents and Trademarks*